US009225052B2

(12) United States Patent
Milroy et al.

(10) Patent No.: US 9,225,052 B2
(45) Date of Patent: Dec. 29, 2015

(54) RUGGEDIZED LOW-RELECTION/HIGH-TRANSMISSION INTEGRATED SPINDLE FOR PARALLEL-PLATE TRANSMISSION-LINE STRUCTURES

(71) Applicant: ThinKom Solutions, Inc., Torrance, CA (US)

(72) Inventors: William Milroy, Torrance, CA (US); James Sor, San Pedro, CA (US)

(73) Assignee: ThinKom Solutions, Inc., Hawthorne, CA (US)

( * ) Notice: Subject to any disclaimer, the term of this patent is extended or adjusted under 35 U.S.C. 154(b) by 0 days.

(21) Appl. No.: 14/013,055

(22) Filed: Aug. 29, 2013

(65) Prior Publication Data

US 2015/0061796 A1 Mar. 5, 2015

(51) Int. Cl.

| | |
|---|---|
| ***H01P 5/00*** | (2006.01) |
| ***H01P 3/00*** | (2006.01) |
| ***H01P 3/12*** | (2006.01) |
| *H01P 1/162* | (2006.01) |
| *H01P 1/08* | (2006.01) |
| *H01P 1/16* | (2006.01) |
| *H01P 1/04* | (2006.01) |
| *H01P 1/06* | (2006.01) |

(52) U.S. Cl.

CPC *H01P 3/003* (2013.01); *H01P 3/12* (2013.01); *H01P 1/042* (2013.01); *H01P 1/064* (2013.01); *H01P 1/08* (2013.01); *H01P 1/16* (2013.01); *H01P 1/162* (2013.01)

(58) Field of Classification Search

None

See application file for complete search history.

(56) References Cited

U.S. PATENT DOCUMENTS

| | | | | |
|---|---|---|---|---|
| 3,605,046 | A | 9/1971 | Miller | |
| 3,771,077 | A | 11/1973 | Tischer | |
| 3,771,078 | A * | 11/1973 | Kidner et al. | 333/242 |
| 3,772,619 | A * | 11/1973 | Clarricoats | 333/242 |
| 4,260,964 | A * | 4/1981 | Saul | 333/26 |
| 4,270,964 | A * | 6/1981 | Flaskett | 156/228 |
| 5,202,650 | A * | 4/1993 | Krill et al. | 333/34 |
| 6,628,242 | B1 | 9/2003 | Hacker et al. | |
| 6,853,073 | B2 * | 2/2005 | Pillet et al. | 257/728 |
| 7,868,714 | B1 | 1/2011 | Sorensen et al. | |
| 2004/0108921 | A1 * | 6/2004 | Sacco | 333/239 |
| 2011/0135844 | A1 * | 6/2011 | Sorensen et al. | 427/578 |
| 2011/0267152 | A1 | 11/2011 | Lee | |
| 2012/0062346 | A1 * | 3/2012 | McKinzie, III | 333/251 |

FOREIGN PATENT DOCUMENTS

JP H10 303611 11/1998

OTHER PUBLICATIONS

Extended European Search Report dated Feb. 10, 2015 for corresponding European application No. 14182652.9 filed on Aug. 28, 2014.

* cited by examiner

*Primary Examiner* — Tuan T Lam

(74) *Attorney, Agent, or Firm* — Renner, Otto, Boisselle & Sklar, LLP.

(57) ABSTRACT

A radio frequency (RF) transmission-line structure includes a parallel-plate transmission line formed from a first conducting plate and a second conducting plate. The second conducting plate is spaced apart from the first conducting plate and substantially parallel to the first conducting plate. A support member is attached to the first and second plates and is operative to maintain a fixed mechanical spacing between the first conducting plate and the second conducting plate. The transmission-line structure further includes at least one feature configured to isolate or suppress RF interaction of the support member with RF fields within the parallel-plate transmission line.

19 Claims, 6 Drawing Sheets

(Dual/Broadband) Open-Circuited Shunt-Series Stub

Note: Shown Features are Surfaces of Revolution (i.e. Cylindrical)

Note: Shown Features are Surfaces of Revolution (i.e. Cylindrical)
40
12a
16
42a
24
12b
18
42b
42
Shorted Coax and Dielectric Surface may or may not be present 12a
16
52
24
12b
50
18
Shorted Coax and Dielectric Surface may or may not be present 12a
16
24
12b
18
62
60

Spindle (In-Band) Showing Absence of Reflected-Wave and Clean Transmission ("Invisible Spindle")

Spindle (Out-of-Band) Showing Undesired Reflected-Wave and Corrupted Transmitted Fields

RUGGEDIZED LOW-RELECTION/HIGH-TRANSMISSION INTEGRATED SPINDLE FOR PARALLEL-PLATE TRANSMISSION-LINE STRUCTURES

TECHNICAL FIELD

The present invention relates generally to parallel-plate transmission-line structures and, more particularly, to a mechanical/electrical support member that supports and maintains a desired mechanical spacing between two parallel conducting plates, and systems incorporating the same.

BACKGROUND ART

In recent years, a great demand has emerged for the production of low-cost and high-performance antennas in the microwave and millimeter-wave range, especially for telecommunications, radar and monitoring applications. Planar solutions, employing parallel-plate-based RF transmission-line systems, have been proposed and are considered to be the most advantageous in terms of frequency bandwidth performance, cost, RF insertion loss, and overall compactness.

A problem with open microwave structures with large mechanically-unsupported RF-active regions, such as parallel-plate structures, is their susceptibility to mechanical shock, vibration, and/or deformation, which undesirably alters the RF properties of the structure (resonant frequency, propagation speed, field uniformity, etc.) In the special case of antenna structures employing parallel-plate transmission lines realized as large open regions, undesired deformation in the spacing and/or shape of the parallel-plate surfaces creates detrimental impacts on antenna pattern gain and sidelobe properties.

SUMMARY OF INVENTION

To address the above problem, a fixed solid or porous low-loss dielectric can be employed between the plates to provide internal mechanical support in open microwave structures. However, such configurations experience undesired perturbation or large-scale modification of internal RF fields and microwave characteristics, resulting in decreased wavelength, potential inhomogeneity, increased weight, cost, and dissipative loss.

Alternatively, one or more discrete conductive or dielectric posts or the like may be employed to mechanically interconnect opposing parallel-plate surfaces. Such posts, however create internal RF short-circuit boundary conditions which create undesired RF reflections and impede and/or modify internal fields and propagating waves within the structure and thus the resultant microwave properties of the structure.

Another option is to thicken, reinforce, and/or otherwise mechanically strengthen the individual parallel-plate surfaces in order to minimize flexure and deviation of the spacing between opposing plates. However, this adds undesired weight and thickness and/or may not be practical depending on other microwave features or details which may be required for RF and/or operational functionality.

A transmission-line structure in accordance with the present invention utilizes mechanical and/or RF features, such as a RF-choked coaxial structure, that electrically isolate a mechanical connection between parallel-plates of a parallel-plate transmission-line structure, thereby mitigating or eliminating undesired impacts of the mechanical connection on the desired RF properties of the microwave structure while retaining the desired mechanical properties. In addition (or alternatively), a mechanical connection between parallel-plates in the form of a support member may include features that electrically isolate the support member from the parallel-plates, while enabling rotation of one plate relative to the other plate.

According to one aspect of the present invention, a radio frequency (RF) transmission-line structure includes: a parallel-plate transmission line formed from a first conducting plate and a second conducting plate, the second conducting plate spaced apart from the first conducting plate and substantially parallel to the first conducting plate; a support member having a first part and a second part, the first part connected to the first conducting plate and the second part connected to the second conducting plate, the support member operative to maintain a fixed mechanical spacing between the first conducting plate and the second conducting plate; and at least one feature configured to isolate or suppress RF interaction of the support member with RF fields within the parallel-plate transmission line.

According to one aspect of the invention, the at least one feature comprises at least one of coaxial or radial RF choke feature configured to inhibit longitudinal currents along a surface of the support member bridging the first and second conducting plates.

According to one aspect of the invention, the at least one feature includes a choked coaxial structure configured to electrically isolate a mechanical connection between the first and second conducting plates.

According to one aspect of the invention, the choked coaxial structure creates a floating ground at a surface of the first or second conducting plate.

According to one aspect of the invention, the at least one feature includes at least one of an RF feature or a mechanical feature.

According to one aspect of the invention, the at least one feature includes an RF feature connected to at least one of the first or second conducting plates.

According to one aspect of the invention, both the first and second conducting plates comprise at least one RF feature, and the at least one RF feature on one of the first conducting plate or second conducting plate is configured to resonate at a frequency offset from a resonant frequency of the at least one feature on the other of the first conducting plate or second conducting plate.

According to one aspect of the invention, the at least one feature includes a mechanical feature arranged on the support member.

According to one aspect of the invention, the at least one feature arranged on the support member includes alternating layers of conductive material and dielectric material.

According to one aspect of the invention, the at least one feature arranged on the support member includes an external serration.

According to one aspect of the invention, the at least one feature includes a groove formed on an external surface of the support member, the groove configured to suppress currents on the external surface of the support member.

According to one aspect of the invention, the at least one feature includes a cavity formed within the support member, the cavity configured to suppress currents on a surface of the support member.

According to one aspect of the invention, the support member is substantially electrically invisible to RF fields propagating within the parallel-plate transmission line.

According to one aspect of the invention, the first conducting plate is positionally fixed with respect to the second conducting plate.

According to one aspect of the invention, the first conducting plate is rotatable relative to the second conducting plate.

According to one aspect of the invention, the support member has a longitudinal axis, and the first conducting plate is rotatable relative to the second conducting plate about the longitudinal axis of the support member.

According to one aspect of the invention, the device includes a rotatable member coupled to the support member, the rotatable member enabling rotation of the first conducting plate relative to the second conducting plate.

According to one aspect of the invention, the rotatable member includes a bearing.

According to one aspect of the invention, the bearing is configured to provide a sliding conductive path to the support member.

According to one aspect of the invention, the rotatable member includes a sleeve.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION OF INVENTION

Figure 1A:
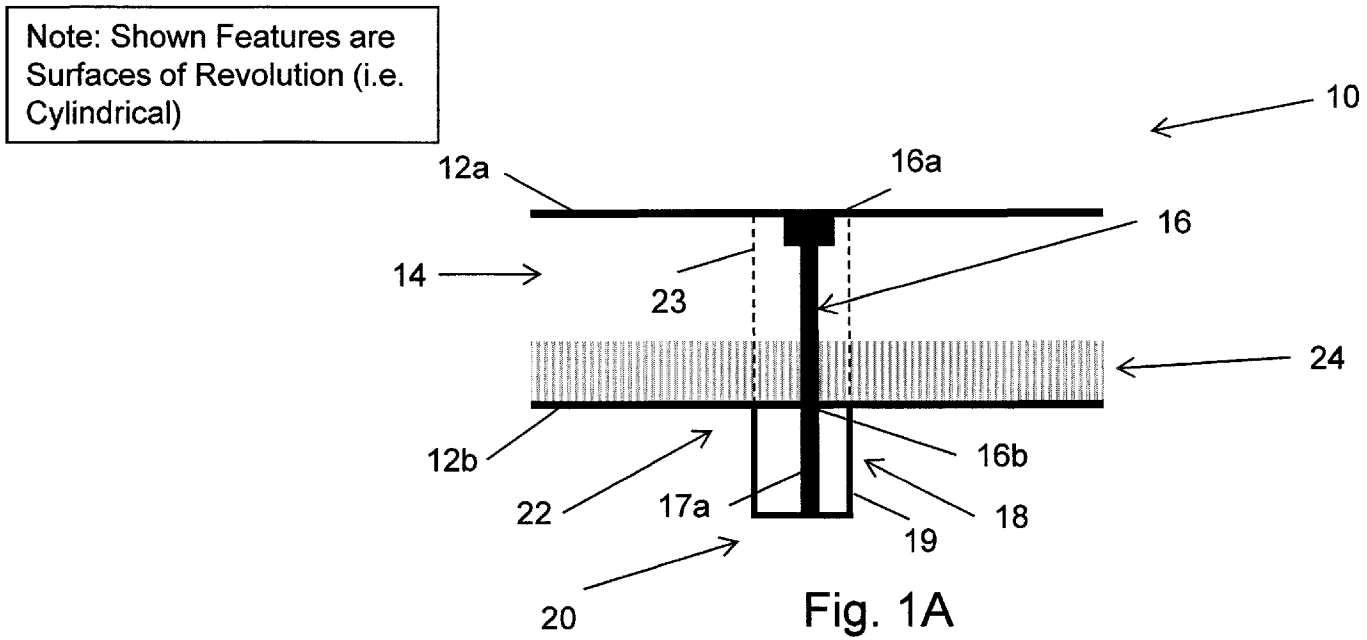
FIG. 1A is a cross-sectional view of a parallel-plate transmission-line structure including exemplary features for suppressing RF interaction of a support member with propagating waves in accordance with an embodiment of the invention. (Illustrated features as shown are a surfaces-of-revolution, i.e. cylindrical)

As used herein, the term "parallel-plate" refers to a type of RF transmission line that includes two parallel-plates offset by an air or dielectric region where RF fields may exist and propagate. The term "choke" refers to a non-contacting RF structure that isolates and/or creates a "virtual" RF short-circuit and/or open-circuit condition. The term "floating ground" refers to an RF or electrical structure that has a conductive feature/detail that is purposefully DC (and RF) isolated from one or more proximal conductive surfaces.

An exemplary radio-frequency (RF) transmission-line structure in accordance with the present invention includes two conducting parallel-plates mechanically coupled to one another via a support member, such as a post or a spindle structure. The support member provides enhanced mechanical rigidity between the parallel-plates, thereby making the transmission-line structure less susceptible to the effects of shock and vibration. More specifically, the support member provides a mechanical structure that supports and maintains a desired mechanical spacing between the two parallel-plates and may also allow for mechanical rotation. In addition, the transmission-line structure includes features that minimize interaction of the support member with fields propagating between the parallel-plates, thereby enhancing signal quality.

For example, RF and/or mechanical features may be included in the transmission-line structure to efficiently isolate/suppress or prevent the support member from interfering with RF fields propagating between the parallel-plates. In addition, a surface of one or both plates may contain one or more features, e.g., detailed RF structures such as corrugated structures, a partially dielectrically-filled plate surface or the like to further enhance RF signal quality and provide desired RF properties.

The transmission-line structure in accordance with the present invention will be described in the context of a parallel-plate transmission-line structure. Such transmission-line structure may be in the form of a fixed open parallel-plate transmission-line structure (e.g., two opposing conducting parallel-plates that are fixed relative to each other), or a movable parallel-plate transmission-line structure (e.g., two conducting parallel-plates that are rotatable relative to each other about an axis, such as an axis defined by the support member).

It should be appreciated, however, that aspects of the invention may be used with other types of transmission-line structures, including, but not limited to, a Continuous Transverse Stub (CTS) and a Variable Inclination Continuous Transverse Stub (VICTS) antenna array. A CTS is a type of antenna employing a parallel-plate transmission line in its construction. A VICTS antenna array is a particular variant of the CTS array where the upper parallel-plate is allowed to rotate relative to the lower parallel-plate. Aspects of the present invention are also applicable to any open RF transmission line structure with bounded internal fields (parallel-plate, waveguide, resonant cavities, etc.).

Referring to FIG. 1A, a cross-section of an exemplary parallel-plate transmission-line structure 10 in accordance with the present invention is shown. The transmission-line structure 10 includes two conductive parallel-plates 12*a* and 12*b* defining an open parallel-plate transmission-line 14 through which microwaves may propagate. A support member 16 includes a first part 16*a* connected to a first plate 12*a*, and a second part 16*b* connected to a second plate 12*b*, the support member 16 maintaining a fixed spacing between the first and second plates 12*a* and 12*b*. The support member 16 can be formed, for example, as a bare or dielectrically-sleeved metallic probe or the like.

The support member 16 may be fixed to both plates 12*a* and 12*b* so as to inhibit rotational movement of the first plate 12*a* relative to the second plate 12*b*. Alternatively, the support member 16 may be configured as a spindle or the like that enables rotational movement of the first plate 12*a* relative to the second plate 12*b* (e.g., a rotatable member may be coupled between the support member 16 and the plates, such as the first plate 12*a*). Further details regarding rotational embodiments of the transmission-line structure are described below with respect to FIGS. 4A-4C.

The exemplary transmission-line structure 10 may include a number of RF and/or mechanical features that isolate, suppress or prevent the support member 16 from interfering with RF fields propagating between the parallel-plates 12*a* and 12*b*. For example, the transmission-line structure 10 may include a first (lower) choke structure 18, such as a coaxial choke structure, embedded in the lower plate 12*b* (e.g., the choke structure 18 is attached to or integrated with the lower plate 12*b*). A center conductor of the coaxial choke structure 18 can be formed by a portion 17*a* of the support member 16 extending below the second plate 12*b*, and an outer conductor 19*a* of the coaxial choke structure 18 can be formed from a conductive material surrounding the portion 17*a* of the support member 16 extending below the second plate 12*b*. The area between the outer conductor 19*a* and the portion 17*a* of the support member 16 can comprise air, dielectric material, etc. depending on the needs of the specific application.

The transmission-line structure 10 may optionally include non-conductive coaxial sleeve 23 arranged over the support member 16. The non-conductive sleeve 23 adds mechanical rigidity to the support member 16 and can further suppress interaction of the support member 16 with waves propagating through the parallel-plate transmission line 14. Typical non-conductive materials (for the non-conductive sleeve) include but are not limited to Teflon, Polycarbonate, Polypropylene, Polystyrene, and similar "low-loss" dielectrics.

Additionally or alternatively, a surface of one or both plates 12*a* and 12*b* may contain one or more features 24, e.g., detailed RF structures such as corrugated structures, a partially dielectrically-filled plate surface or the like. The features 24 can further minimize undesired interaction of the support member 16 with Radio Frequency (RF) fields propagating between the two plates 12 and 12*b*. The surface features 24 are well-known and thus further discussion of such features is not provided herein. It is noted that the features 24, while influencing the isolation/suppression properties of the transmission-line structure, without the coaxial or the other alternative methods described herein, do not independently isolate or suppress RF interaction of the support member with RF fields within the parallel-plate transmission line.

Figure 1C:
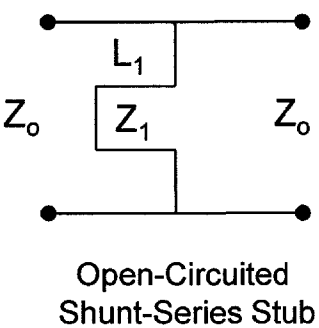
FIG. 1C illustrates an equivalent circuit model of the support member according to FIG. 1A.
Figure 1B:
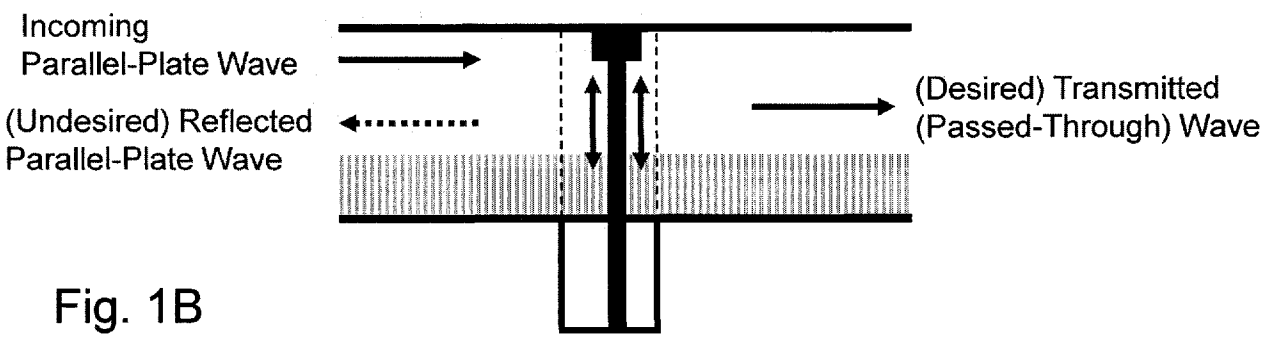
FIG. 1B illustrates fields and currents in the support member according to FIG. 1A.

With additional reference to FIG. 1B, exemplary currents and fields propagating through the transmission-line structure 10 are illustrated. As shown in FIG. 1B, an incoming parallel-plate wave passes between the plates 12*a* and 12*b*. Due to interaction with the support member 16, a portion of the wave may be reflected back out of the structure, and the remainder of the wave passes through the structure.

In accordance with the present invention, the first choke structure 18 creates a virtual open circuit in the region 22 on or near the lower plate 12*b*. The open-circuit condition creates a "floating ground" and RF isolation of the conductive support member 16, which inhibits longitudinal currents along the surface of the conductive support member 16 that bridge the upper and lower plates 12*a* and 12*b*. As a result, the currents flowing in the portion of the support member 16 outside the parallel-plate transmission line 14 (e.g., in the region beneath the second plate 12*b*, particularly near the lower-most boundary of the transmission-line structure 10) are relatively high, while the currents flowing in the portion of the support member 16 between the parallel-plates 12*a* and 12*b* are relatively low. The reduced currents between the parallel-plates 12*a* and 12*b* minimize interaction between the support member 16 and the waves propagating through the parallel-plate transmission-line 14. As a result, reflected waves are minimized.

Briefly referring to FIG. 1C, an equivalent circuit of the transmission-line structure 10 of FIG. 1A is shown. The circuit effectively forms open-circuit shunt-series stub. The impedance $Z_0$ corresponds to the characteristic impedance of the parallel-plates 12*a* and 12*b*, and the impedance $Z_1$ corresponds to the characteristic impedance of the first choke structure 18 (the value of $L_1$ corresponds to the electrically-equivalent depth of the first choke structure 18 below the plate 12*b* and is generally selected based on desired operating frequency properties.

Figure 2B:
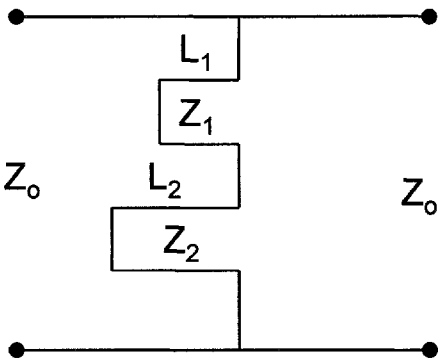
FIG. 2B illustrates an equivalent circuit model of the support member according to FIG. 2A.
Figure 2A:
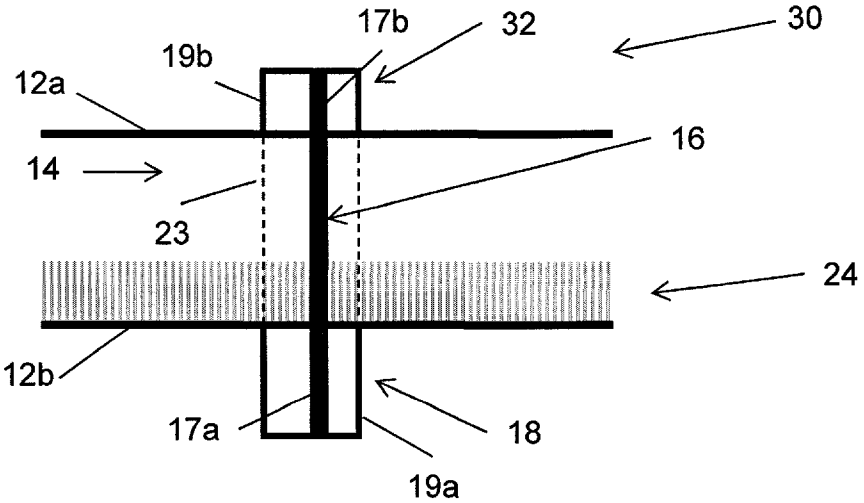
FIG. 2A is a cross-sectional view of a parallel-plate transmission-line structure that includes a two coaxial-chokes in accordance with another exemplary embodiment of the invention.

With reference to FIG. 2A, a cross-section of another exemplary transmission-line structure 30 is shown having a second (upper) choke structure 32 introduced on a surface of the first conducting plate 12*a* (a "dual-choke variant"). Similar to the first choke structure 18, the second choke structure 32 can be a coaxial choke structure formed by the portion 17*b* of the support member 16 extending above the first plate 12*a*. Similar to the first choke structure, an outer conductor 19*b* of the coaxial choke structure 32 can be formed from a conductive material surrounding the portion 17*b* of the support member 16 extending above the first plate 12*a*. The area between the inner conductor and the outer conductor can comprise air, dielectric material, etc. The second choke structure 32 can further enhance the RF isolation of the support member 16, and may be designed to resonate at a frequency offset from that of the first choke structure 18 (a "dual-band variant"), thereby providing enhanced broadband isolation characteristics. Desired broadband or dual-band operating frequencies are generally controlled through proper selection of choke depths L1 and L2, while specific "Q" (individual bandwidths) is generally controlled through proper selection of choke impedances Z1 and Z2.

FIG. 2B illustrates the equivalent circuit for the transmission-line structure 30. In the circuit of FIG. 2B, the impedance $Z_0$ corresponds to the characteristic impedance of the parallel-plates 12*a* and 12*b*, the impedance $Z_1$ corresponds to the characteristic impedance of the second (upper) choke structure 32, and the impedance $Z_2$ corresponds to the characteristic impedance of the first (lower) choke structure 18. $L_1$ and $L_2$ correspond to the length the second choke structure 32 and first choke structure 18, respectively, extend outside the parallel-plate transmission line 14.

Figures 3A, 3B, 3C:
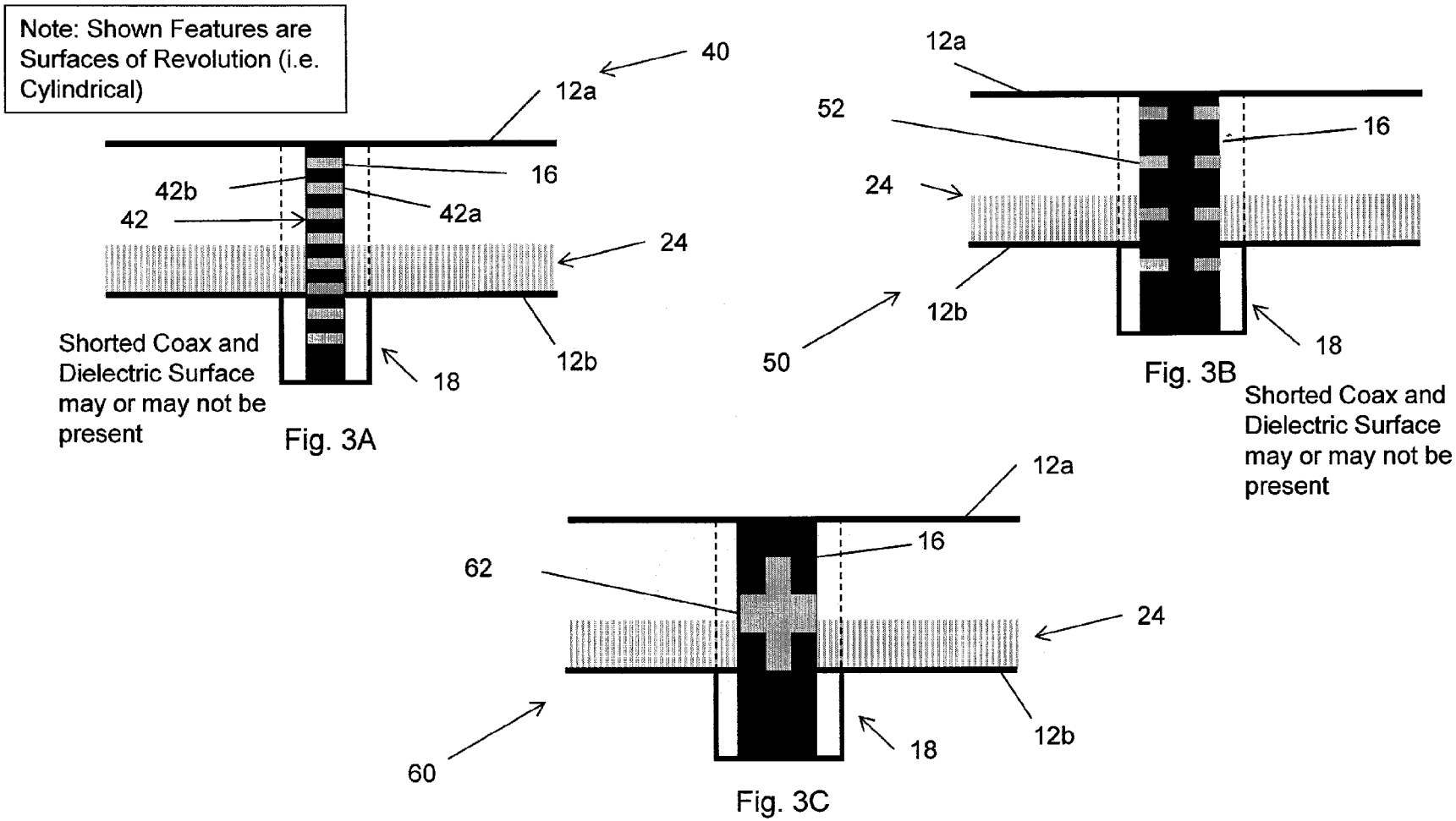
FIG. 3A is a cross-sectional view of a parallel-plate transmission-line structure that includes dielectric lamination of the support member in accordance with another exemplary embodiment of the invention.
FIG. 3B is a cross-sectional view of a parallel-plate transmission-line structure that includes a serrated/choked support member in accordance with another exemplary embodiment of the invention.
FIG. 3C is a cross-sectional view of a parallel-plate transmission-line structure that includes a support member having an internal choke cavity in accordance with another exemplary embodiment of the invention.

In accordance with another embodiment, the support member 16 can include coaxial and radial RF choke features that serve to create a desired RF functionality as well as a desired mechanical strength and stability for the plates 12*a* and 12*b*. More specifically, the RF properties of the support member 16 may be enhanced through candidate modifications of the conducting "RF floating" support member. With reference to FIG. 3A, a cross-section of a parallel-plate transmission-line structure 40 is shown, the parallel-plate transmission-line structure including a support member 16 having dielectric laminations 42 forming at least part of the support member 16. More specifically, alternating discs of conductor 42*a* and low-loss dielectric 42*b* are employed in the dielectric lamination 42 to further isolate and minimize current carrying portions of the support member 16. The alternating layers of conductor material and dielectric material minimize and/or eliminate currents flowing in a surface of the support member 16. In forming the support member 16, the alternating layers of conductor 42*b* and low-loss dielectric 42*a* can be stacked one over the other, and an adhesive (not shown) can be used to mechanically secure the layers to one another. Any "typical" means for forming the structure would be acceptable, as long as the resultant "laminated" structure is mechanically strong so as to maintain the spacing between the first and second plates 12*a* and 12*b*.

In accordance with another embodiment, FIG. 3B illustrates a cross-section of an exemplary parallel-plate transmission-line structure 50 having choking serrations/grooves 52 formed in an external surface of the conductive support member 16. The serrations/grooves 52, which circumscribe the support member 16, create a virtual open circuit (or more generally, a complex impedance) on the surface of the cylindrical support member 16. The net result of the serrations/grooves 52 is that current flow on the surface of the support member 16 is suppressed, thereby minimizing interaction between a wave propagating through the parallel-plate transmission line 14 and the support structure 16.

FIG. 3C illustrates a cross-section of another exemplary parallel-plate transmission-line structure 60 that includes an internal choking cavity 62 incorporated within a conductive support member 16. The cavity 62, for example, may be formed from a non-conductive center section (e.g., plastic, Teflon®, etc.) surrounded by conductive (e.g., metal) end sections. The center-section is hollow, and may or not be filled with dielectric material. The cavity resonant frequency is a (somewhat complex) function of the internal mechanical details of the cavity. Preferably, an interface between the center section and the end section permits relative rotation between the end sections (and thus between the plates 12 and 12*b*). The cavity 62 inhibits current flow through the support member 16, thereby minimizing any interaction of the support member 16 with the currents and fields propagating between the plates 12*a* and 12*b*.

It is noted that the embodiments of FIGS. 3A-3C and 4A-4B, while shown in combination with a coaxial choke structure 18, can/do provide favorable isolation/suppression properties all by themselves. In other words, such embodiments may provide favorable results even without the coaxial choke structure 18.

Figure 4B:
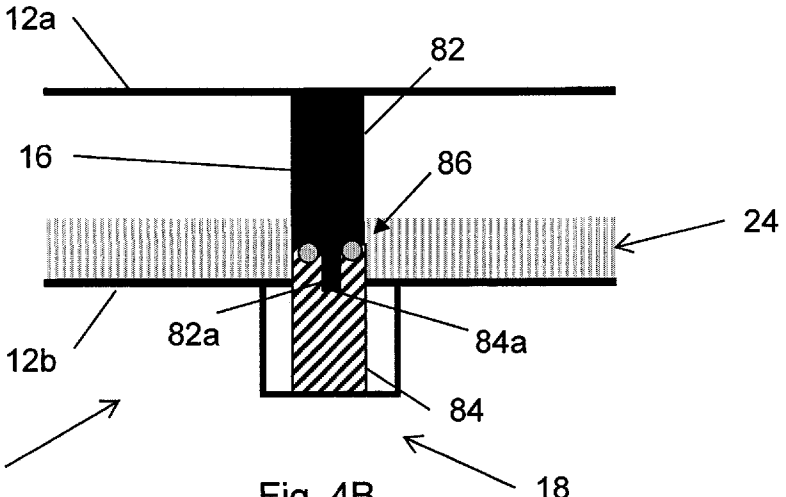
FIG. 4B is a cross-sectional view of a parallel-plate transmission-line structure having parallel-plates rotatably coupled to one another via a split-shaft support member having a conductive bearing arranged within the support member in accordance with another embodiment of the invention.
Figure 4A:
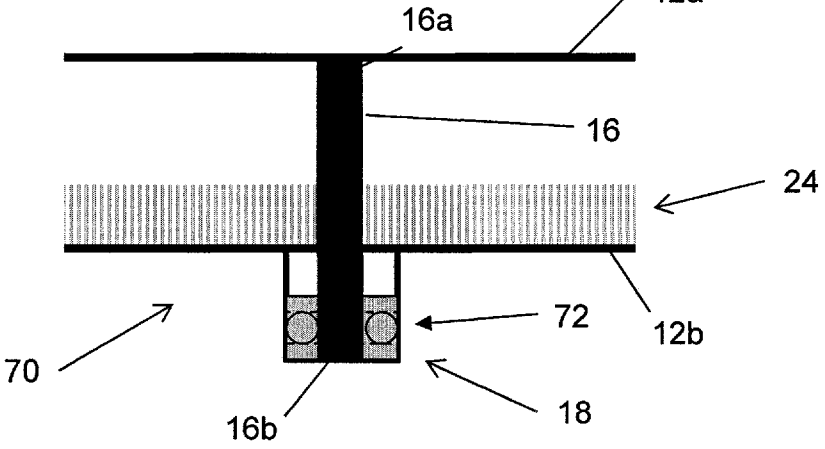
FIG. 4A is a cross-sectional view of a parallel-plate transmission-line structure having parallel-plates rotatably coupled to one another via a support member connected to a conductive bearing arranged on one plate in accordance with another embodiment of the invention.
Figure 4C:
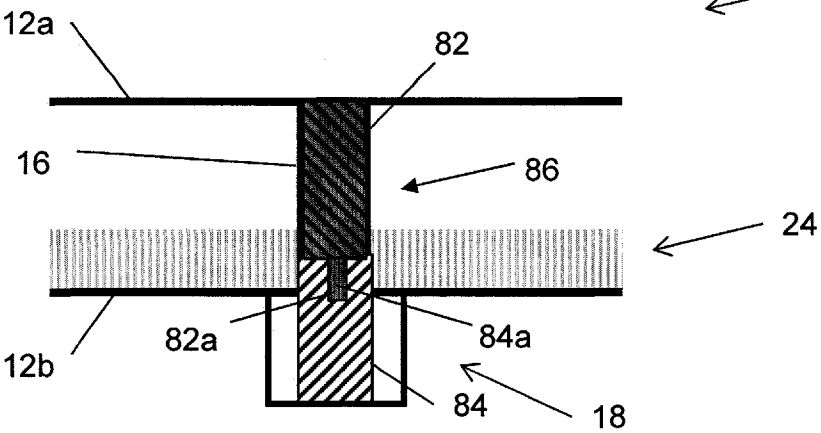
FIG. 4C is a cross-sectional view of a parallel-plate transmission-line structure having parallel-plates rotatably coupled to one another via a split-shaft support member having a non-conductive Teflon sleeve arranged within the support member in accordance with another embodiment of the invention.

Moving now to FIGS. 4A-4C, several embodiments of a rotatable parallel-plate transmission-line structure in accordance with the present invention are shown in cross-section. In the illustrated embodiments, a rotatable member may be coupled to the support member 16, thereby allowing one plate to rotate relative to the other plate. It should be appreciated that the features of the support member 16 described with respect to FIGS. 3A-3C can be employed in the embodiments shown in FIGS. 4A-4C.

With reference to FIG. 4A, a parallel-plate transmission-line structure 70 includes upper and lower plates 12*a* and 12*b*, features 24 formed on a surface of one or both plates, a support member 16 as described with respect to FIG. 1A. A rotatable member 72 is attached to the choke structure 18 beneath the second plate 12*b* to enable rotational movement of the first plate 12*a* relative to the second plate 12*b*. The rotatable member 72 may include a bearing, such as a ball bearing or the like, arranged within the first choke structure 18. Preferably, the rotatable member 72 is conductive, e.g., the internal races of the bearing can form a sliding conductive path at the base of the coaxial-choking structure 18. The rotatable member 72 can provide both a mechanical function (e.g., centering the support member 16 in the choke structure 18) and an electrical function (grounding) functions.

In the embodiment shown in FIG. 4A, one end 16*a* of the support member 16 is fixedly attached, for example, to the first plate 12*a* thereby inhibiting relative movement between the support member 16 and the first plate 12*a*. The other end 16*b* of the support member 16 is attached to the rotatable member 72, thereby enabling rotational movement of the support member 16 (and thus of the upper plate 12*a*) relative to the second plate 16*b*.

Moving now to FIG. 4B, another exemplary rotatable parallel-plate transmission-line structure 80 is shown. In the embodiment shown in FIG. 4B, the rotatable member is introduced at or near a center of the conducting support member 16, e.g., the support member 16 is split into two parts. A first part 82 of the support member 16 is fixedly attached to the upper plate 12*a*, and a second part 84 is fixedly attached to the lower plate 12*b*. The second part 84 may include a recess 84*a*, e.g., a cylindrically-shaped hole, and the first part 82 may include a protrusion 82*a* corresponding to the recess 84*a*. As will be appreciated, the protrusion 82*a* and recess 84*a* may be formed having any shape so long as when the protrusion and recess are engaged the first part 82*a* can rotate relative to the second part 84*a*. A conductive or non-conductive bearing detail 86 or the like can be arranged between the first and second parts 82*a* and 84*a* so as to enhance rotational movement of the first part 82*a* relative to the second part 84*a*.

FIG. 4C illustrates another exemplary embodiment of a rotatable parallel-plate transmission-line structure 90 in accordance with the present invention. The transmission-line structure 90 is similar to the structure 80 of FIG. 4B. However, instead of including a conductive or non-conductive bearing detail 86, the embodiment of FIG. 4C includes one or both of the upper and lower parts 82 and 84 being formed from a non-conductive material. For example, the rotatable member can be formed as a plastic or Teflon® sleeve. A Teflon® sleeve is advantageous as it can provide both mechanical friction suppression as well as desired RF isolation of the support member itself.

Figure 5:
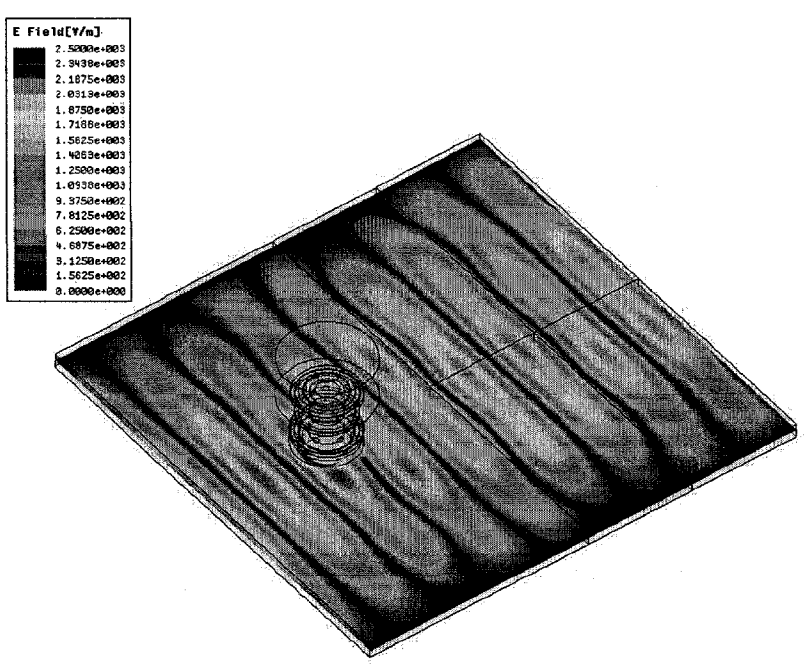
FIG. 5 illustrates simulated fields for a parallel-plate transmission-line structure employing support members in accordance with the present invention.
Figure 6:
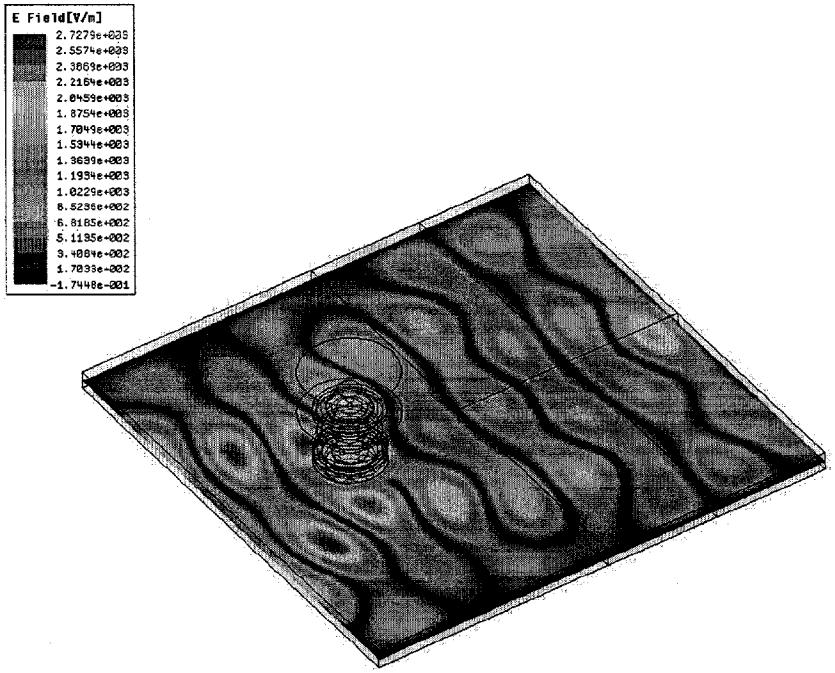
FIG. 6 illustrates simulated fields for a parallel-plate transmission-line structure employing conventional post configuration and illustrating undesired impacts on the RF field characteristics.

Referring now to FIG. 5, shown are simulated fields propagating through a parallel-plate transmission-line structure in accordance with the invention. As can be seen in FIG. 5, the absence of any perturbation or degradation due to the support structure 16 relative to both incident and transmitted fields illustrates the favorable isolation properties of the structure (e.g., a clean wave is transmitted, without any significant signs of a reflected-wave). FIG. 6 illustrates the same incident and transmitting fields with a conventional spindle/post configuration, with strong (undesirable) impact clearly evident.

Figure 7:
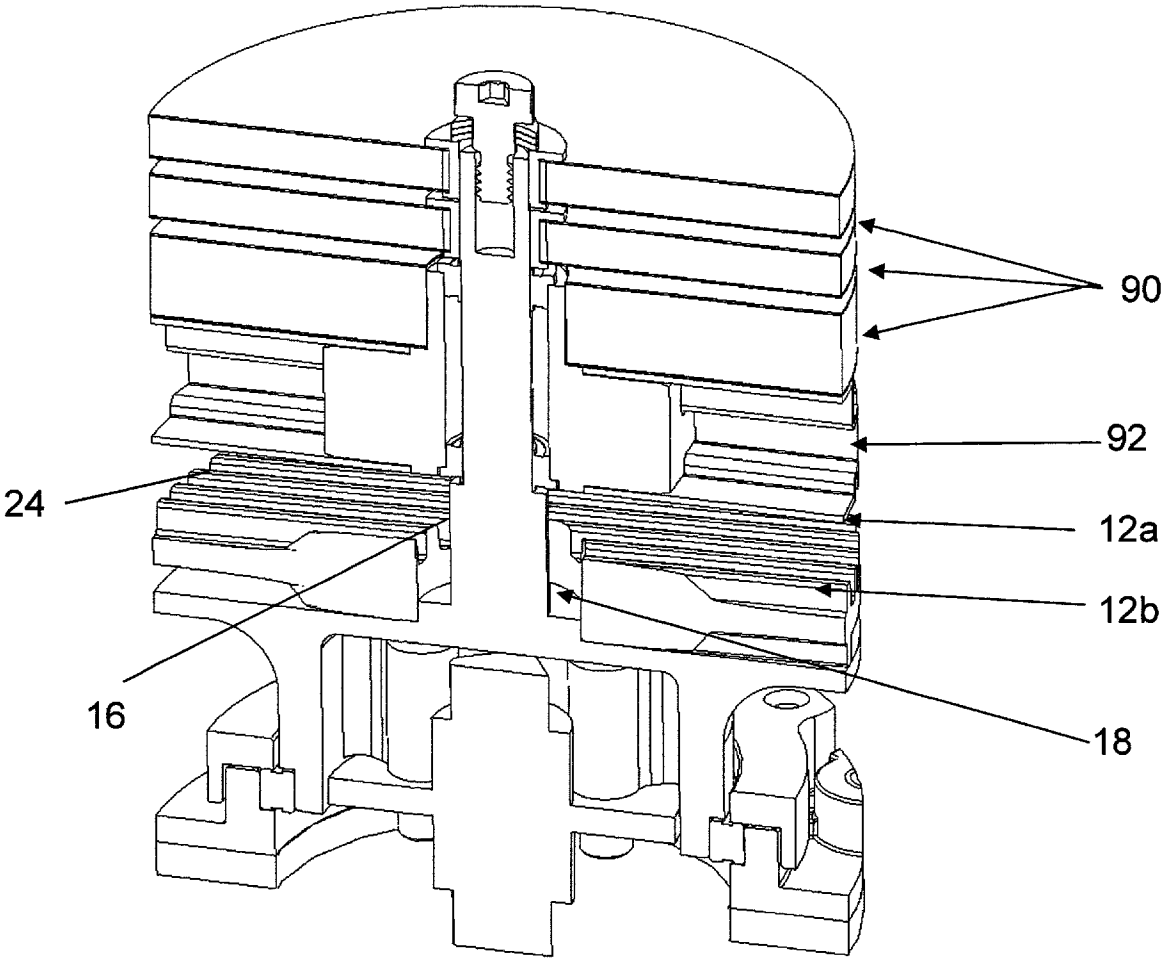
FIG. 7 is a cross-sectional view of an exemplary integrated transmission-line and antenna structure in accordance with an embodiment of the present invention.

Referring now to FIG. 7, a detailed cross-sectional view of an exemplary integrated transmission-line antenna structure in accordance with the present invention is shown. The exemplary transmission-line structure 10 includes first and second parallel-plates 12*a* and 12*b*, the second parallel-plate 12*b* having features 24 (e.g., corrugated features) arranged on a surface of the second plate 12*b*. A support member 16 in accordance with the present invention is attached to the first and second plates 12*a* and 12*b*, thereby maintaining a fixed spacing between the plates. A coaxial choke structure 18 in accordance with the present invention is arranged beneath the second plate 12*b*.

The exemplary integrated transmission-line antenna structure 10 further includes rotating polarizing layers 90 arranged over the first plate 12*a*, and a radiating stub cross section 92 arranged between the first plate 12*a* and the polarizing layers. In this particular (antenna application) embodiment, the radiating stubs selectively couple energy from the parallel-plate energy in order to create a controlled phase and amplitude excitation that is consistent with the desired antenna pattern properties. The polarizing layers provide an additional degree-of-freedom whereby the polarization orientation of the antenna may be independently "twisted" and oriented independent of the orientation of the radiators.

The transmission-line structure described herein not only provides rigid mechanical support for the parallel-plates 12*a* and 12*b*, but also minimizes/eliminates the undesired modification/degradation of the internal RF fields within the open microwave structure. The support member 16 also allows for mechanical rotation about its axis, which is an advantageous benefit/feature when the surfaces of the upper and lower conducting plates 12*a* and 12*b* are required to rotate (as in a "VICTS Array" antenna implementation.)

Accordingly, the transmission-line structure in accordance with the present invention utilizes a support member 16 that provides a reliable ruggedized mechanical connection between opposing parallel-plates 12*a* and 12*b* of the transmission-line structure (thereby maintaining spacing and centering of the plates under induced mechanical shock and vibration), as well as features that make the support member 16 appear electrically (RF) inert (i.e., "invisible" or substantially invisible).

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. A radio frequency (RF) transmission-line structure, comprising:

a parallel-plate transmission line formed from a first conducting plate and a second conducting plate, the second conducting plate spaced apart from the first conducting plate and substantially parallel to the first conducting plate;

a support member having a first part and a second part, the first part connected to the first conducting plate and the second part connected to the second conducting plate, the support member operative to maintain a fixed mechanical spacing between the first conducting plate and the second conducting plate; and at least one feature configured to isolate or suppress RF interaction of the support member with RF fields within the parallel-plate transmission line; and a rotatable member coupled to the support member, the rotatable member enabling rotation of the first conducting plate relative to the second conducting plate.

2. The device according to claim 1, wherein the at least one feature comprises at least one of coaxial or radial RF choke feature configured to inhibit longitudinal currents along a surface of the support member bridging the first and second conducting plates.

3. The device according to claim 1, wherein the at least one feature comprises a choked coaxial structure configured to electrically isolate a mechanical connection between the first and second conducting plates.

4. The device according to claim 3, wherein the choked coaxial structure creates a floating ground at a surface of the first or second conducting plate.

5. The device according to claim 1, wherein the at least one feature comprises at least one of an RF feature or a mechanical feature.

6. The device according to claim 1, wherein the at least one feature comprises an RF feature connected to at least one of the first or second conducting plates.

7. The device according to claim 6, wherein both the first and second conducting plates comprise at least one RF feature, and the at least one RF feature on one of the first conducting plate or second conducting plate is configured to resonate at a frequency offset from a resonant frequency of the at least one feature on the other of the first conducting plate or second conducting plate.

8. The device according to claim 1, wherein the at least one feature comprises a mechanical feature arranged on the support member.

9. The device according to claim 8, wherein the at least one feature arranged on the support member comprises alternating layers of conductive material and dielectric material.

10. The device according to claim 8, wherein the at least one feature arranged on the support member comprises an external serration.

11. The device according to claim 8, wherein the at least one feature comprises a cavity formed within the support member, the cavity configured to suppress currents on a surface of the support member.

12. The device according to claim 1, wherein the support member is substantially electrically invisible to RF fields propagating within the parallel-plate transmission line.

13. The device according to claim 1, wherein the first conducting plate is positionally fixed with respect to the second conducting plate.

14. The device according to claim 1, wherein the first conducting plate is rotatable relative to the second conducting plate.

15. The device according to claim 1, wherein the rotatable member comprises a bearing.

16. The device according to claim 15, wherein the bearing is configured to provide a sliding conductive path to the support member.

17. The device according to claim 1 wherein the rotatable member comprises a sleeve.

18. A radio frequency (RF) transmission-line structure, comprising:

a parallel-plate transmission line formed from a first conducting plate and a second conducting plate, the second conducting plate spaced apart from the first conducting plate and substantially parallel to the first conducting plate;

a support member having a first part and a second part, the first part connected to the first conducting plate and the second part connected to the second conducting plate, the support member operative to maintain a fixed mechanical spacing between the first conducting plate and the second conducting plate; and at least one feature configured to isolate or suppress RF interaction of the support member with RF fields within the parallel-plate transmission line, wherein the at least one feature comprises a mechanical feature arranged on the support member, and wherein the at least one feature comprises a groove formed on an external surface of the support member, the groove configured to suppress currents on the external surface of the support member.

19. A radio frequency (RF) transmission-line structure, comprising:

a parallel-plate transmission line formed from a first conducting plate and a second conducting plate, the second conducting plate spaced apart from the first conducting plate and substantially parallel to the first conducting plate;

a support member having a first part and a second part, the first part connected to the first conducting plate and the second part connected to the second conducting plate, the support member operative to maintain a fixed mechanical spacing between the first conducting plate and the second conducting plate; and at least one feature configured to isolate or suppress RF interaction of the support member with RF fields within the parallel-plate transmission line, wherein the first conducting plate is rotatable relative to the second conducting plate, and, wherein the support member has a longitudinal axis, and the first conducting plate is rotatable relative to the second conducting plate about the longitudinal axis of the support member.

* * * * *